US006280343B1

(12) United States Patent
Scheid et al.

(10) Patent No.: US 6,280,343 B1
(45) Date of Patent: Aug. 28, 2001

(54) METHOD OF ADAPTING A RELATIVELY SMALL NUMBER OF BOWLING BALLS FOR TESTING USE BY A RELATIVELY LARGE NUMBER OF BOWLERS

(75) Inventors: William T. Scheid, Hopkinsville; Charles W. Venable, Pembroke; Joe L. Hester, Hopkinsville; Robert E. Hoagland, Eddyville, all of KY (US)

(73) Assignee: Ebonite International, Inc., Hopkinsville, KY (US)

( * ) Notice: Subject to any disclaimer, the term of this patent is extended or adjusted under 35 U.S.C. 154(b) by 0 days.

(21) Appl. No.: 09/528,301

(22) Filed: Mar. 17, 2000

(51) Int. Cl.[7] ..... A63B 37/00
(52) U.S. Cl. ..... 473/54; 473/125; 473/130
(58) Field of Search ..... 473/125, 128, 473/129, 130, 54

(56) References Cited

U.S. PATENT DOCUMENTS 3,001,793 * 9/1961 Insetta .
3,129,002 * 4/1964 Bednash .
3,383,109 * 5/1968 Jankiewicz et al. .
5,118,106 * 6/1992 Goldman .

* cited by examiner

*Primary Examiner*—William M. Pierce
(74) *Attorney, Agent, or Firm*—Cook,Alex,McFarron,Manzo,Cummings & Mehler, Ltd.

(57) ABSTRACT

A method for adapting a relatively small number of bowling balls for use in testing by a relatively large number of bowlers having different hand sizes. The method includes the steps of predrilling a pair of finger holes of a standard size in each of a relatively small number of bowling balls, which finger holes are shaped to receive removable finger inserts of varying sizes. The next step is the predrilling of a thumb hole in each of a relatively small number of bowling balls with the thumb hole in each bowling ball being located at a different, predetermined distance from a pair of finger holes so that each of the thumb holes of the bowling balls are at a different distance from a pair of finger holes. The following step is the installation of a removable insert in each of the thumb holes. Finally, the removable thumb insert is sized to accommodate the thumb of a particular bowler.

5 Claims, 4 Drawing Sheets

3/4

METHOD OF ADAPTING A RELATIVELY SMALL NUMBER OF BOWLING BALLS FOR TESTING USE BY A RELATIVELY LARGE NUMBER OF BOWLERS

BACKGROUND AND SUMMARY OF THE INVENTION

Bowlers like to practice with a new bowling ball to determine its performance attributes before purchasing the ball. This is especially true when the bowling ball is a new model and the rate of introduction of new models of bowling balls is accelerating. Bowlers' hands and thus their hand grips vary in size so usually a bowling ball is custom drilled for each purchaser. A bowling ball is usually shipped from the factory with a pair of finger holes predrilled to a standard diameter with each hole being 31/32" in diameter. Finger inserts of different diameters are then installed in these finger holes to match the finger size of the bowler. However, thumb holes are generally not predrilled because they can vary in their spacing across the surface of the bowling ball from the pair of finger holes over a range of 3" to 5½". If a ball is drilled for a prospective purchaser and that purchaser decides, after trying the bowling ball on a bowling lane, not to purchase it, then the seller has a bowling ball in stock that cannot be custom drilled for another customer. In today's market, different types of bowling balls are being introduced at high rate. Customers would like to try each of the different models of bowling balls to determine which is best suited to the individual bowler's game. This normally require custom drilling of each model of each bowling ball for each customer which is prohibitively expensive.

Accordingly, this invention is directed to a method for drilling a small number of bowling balls for testing by a relatively large number of bowlers having hand spans of different sizes.

It is an object of this invention to provide a bowling ball having a predrilled set of standard finger holes and a predrilled thumb hole at a specified finger thumb span to be adaptable to use by other bowlers with the same finger thumb span but with different finger and thumb diameters.

It is another object of this invention to provide a relatively small number of bowling balls with thumb spans located at intervals of ⅛" in a span of 3" to 5½" which balls can be adapted for use by most bowlers.

Yet another object of this invention is a simplified method of installing a removable thumb insert in a bowling ball.

Still another object of this invention is a method of drilling a thumb insert to a desired diameter while the thumb insert is installed in the bowling ball thumb hole.

A further object of this invention is a method of drilling a thumb insert in the form of a tube to a proper inside diameter when the tube is installed in the bowling ball thumb hole.

Yet an additional object of this invention is a method of locking a cylinder or tube in the thumb hole of a bowling ball to secure it against movement during drilling to a desired finger size.

Other objects of the invention will be found in the following specification, claims and drawings.

BRIEF DESCRIPTION OF THE DRAWINGS

The invention is illustrated more or less diagrammatically in the following drawings wherein.

DESCRIPTION OF THE EMBODIMENTS OF THE INVENTION

Figure 1:
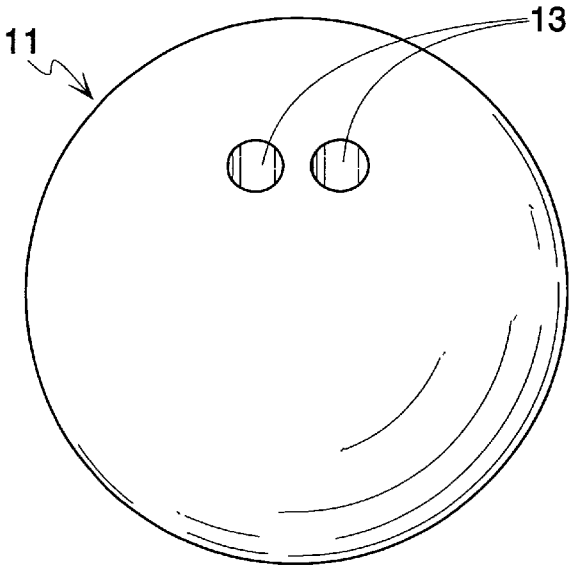
FIG. 1 is a view of a bowling ball with predrilled, standard size finger holes.

FIG. 1 shows a bowling ball 11 of standard size and material predrilled with a pair of finger holes 13. Each finger hole is predrilled to a predetermined depth with a standard 31/32" diameter.

Figure 2:
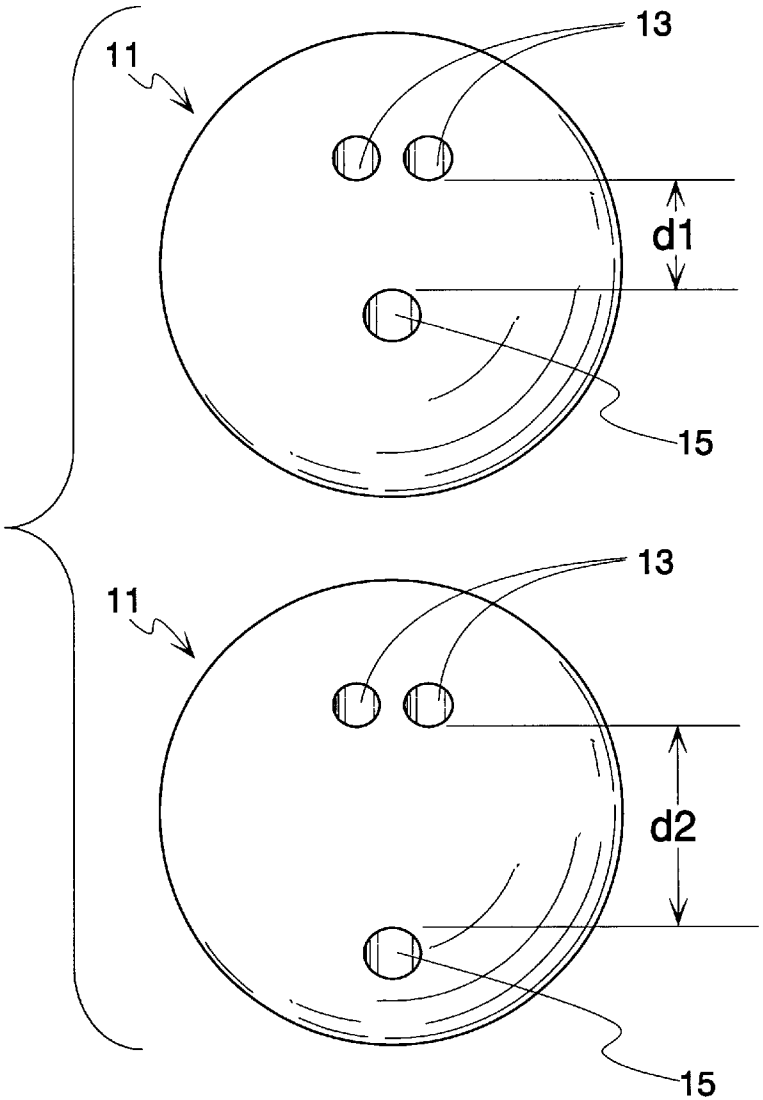
FIG. 2 is a view of two bowling balls, one with a minimum span between drilled finger holes and a thumb hole and the other with a maximum span between the drilled finger holes and a thumb hole.

FIG. 2 shows two bowling balls 11, the first in the upper portion of FIG. 2 being drilled with the standard predrilled finger holes 13 and a thumb hole 15 which is spaced at a distance of d1 from the pair of finger holes. In standard practice, the distance d1 is 3½". The bowling ball 11 shown in the lower portion of FIG. 2 is arranged with a distance of d2 between the predrilled finger holes 13 and the drilled thumb hole 15. In this example, d2 is the maximum distance between finger holes and thumb holes and is 5". It should be understood and appreciated that the thumb hole can be located anywhere between 3½" and 5" at intervals of ⅛". This span between d1 and d2 covers the normal span range of most bowlers and, thus, by measuring the bowler's span and drilling the thumb hole at one of the intervals, either at or between d1 and d2, the bowling ball can be adapted to a particular bowler. Of course, it should be understood that to fit the test bowling ball to any particular bowler, it is necessary to place finger inserts in the finger holes 13, but this can be done using state of the art technology. It is also necessary to provide a properly sized thumb hole insert for installation in the thumb hole 15 and one aspect of this invention is the ability to provide thumb hole inserts in an efficient and economical manner.

Figure 4:
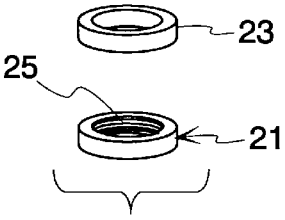
FIG. 4 shows a thumb hole counterbore sleeve before and after the tapping of internal threads in the sleeve.
Figure 3:
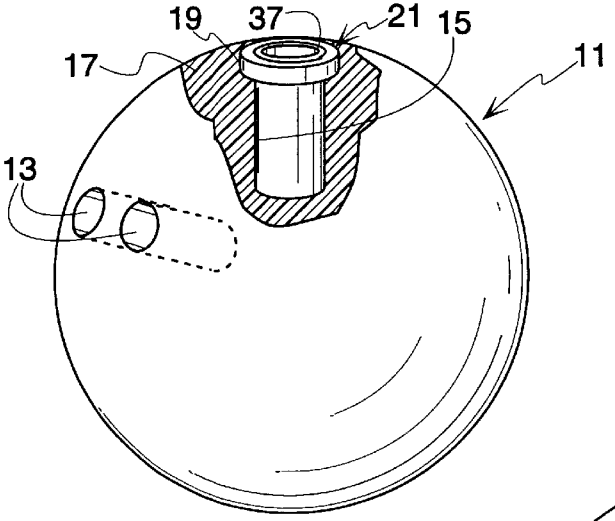
FIG. 3 is a view of a bowling ball with a portion broken away showing a counterbore formed around the thumb hole and a sleeve inserted in the thumb hole.

One manner of installing a removable thumb insert in accordance with the teachings of this invention is shown in FIGS. 3, 4, 5 and 6 of the drawings. In FIG. 3, a portion 17 of the bowling ball is broken away to show the drilled thumb hole 15. A counterbore hole 19 is drilled concentrically with the thumb hole 15 but to a shallower depth. An insert sleeve 21 made of a plasticized PVC, as shown in the lower part of FIG. 4, is created from an annular disk 23 of the same material by tapping internal threads 25. The insert sleeve 21 is positioned in the counterbore 19 as shown in FIG. 3 of the drawings and secured in place by a suitable adhesive. The exposed surface of the sleeve is machined so its outer surface matches the outer spherical surface of the bowling ball 11.

Figure 5:
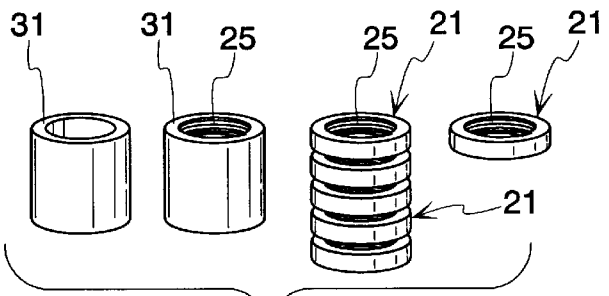
FIG. 5 shows the steps in forming a plurality of threaded counterbore sleeves from a tube.

FIG. 5 of the drawings shows how a plurality of insert sleeves 21 may be made from a tube 31 of material such as plasticized PVC. Internal threads 25 are tapped into the sleeve and the sleeve is then cut into a plurality of insert sleeves 21 shown prior to and after separation moving from the left hand side to the right hand side of FIG. 5 as viewed in the drawings.

Figure 6:
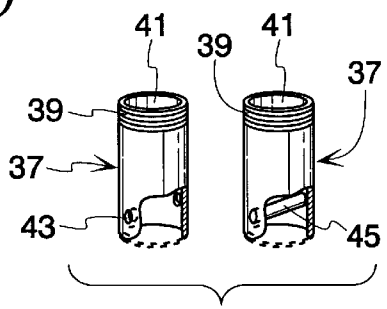
FIG. 6 shows a pair of a thumb insert sleeves having external threads with portions broken away, the sleeve on the left in the drawing showing holes for mounting a removal pin with the removal pin shown installed in the sleeve on the right.

A removable thumb insert 37, which may also be made of plasticized PVC, is shown in the drawings of FIG. 6. This insert is tubular in shape with external threads 39 at one end thereof which are tapped to mesh with the internal threads 25 of the insert sleeve 21 so that the thumb insert may be inserted into the drilled thumb hole 15 and fastened to the insert sleeve 21 as shown in FIG. 3 of the drawings. This insert sleeve, whose internal opening or socket 41 can be varied to match the thumb diameter of a bowler, is formed with diametrically aligned openings 43 in its wall into which is inserted a pin 45 shown in the right hand sleeve as viewed in FIG. 6.

Figure 7:
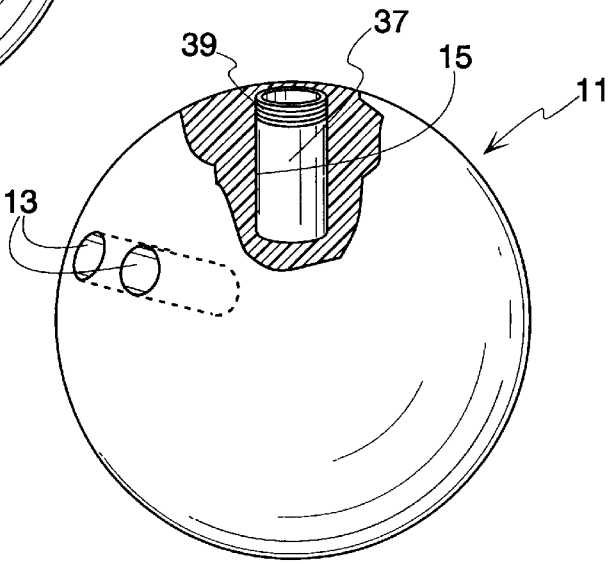
FIG. 7 is a view of a bowling ball with a portion broken away showing the thumb insert of FIG. 6 installed in the thumb hole of the bowling ball.

The removable thumb insert 37 may be also directly inserted into a bowling ball 11 such as that shown in FIG. 7 of the drawings. In this step of the invention, the ball 11 contains the predrilled finger holes 13 and a drilled thumb hole 15. Internal threads (not shown) are threaded at the outlet of the thumb hole 15 to mesh with the external threads 39 on the removable thumb insert 37 as shown in FIG. 7 of the drawings.

Figure 8B:
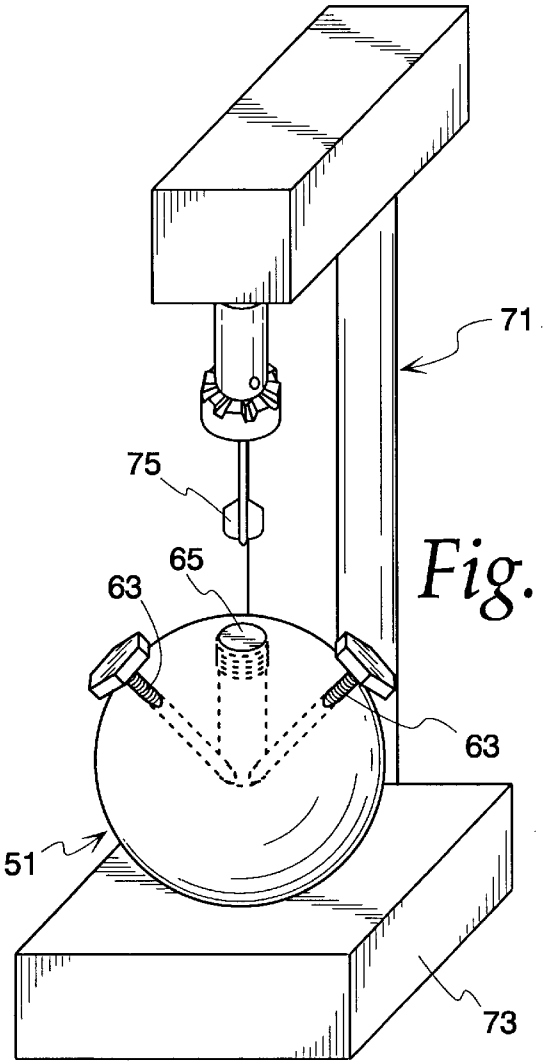
FIG. 8*b* shows a bowling ball fixture located on a drill for drilling an insert positioned in the thumb hole of the fixture.
Figure 8A:
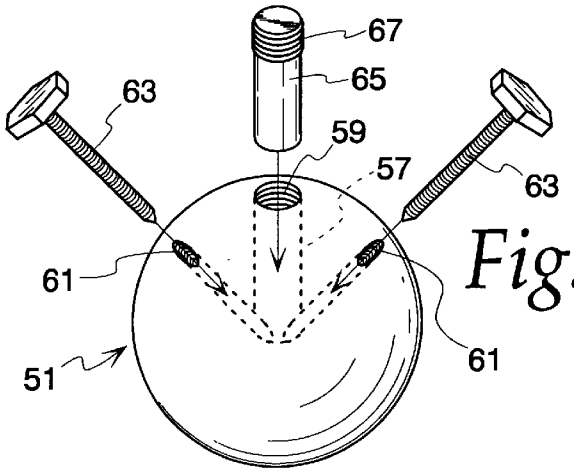
FIG. 8*a* is an exploded view showing a cylindrical insert in a thumb hole of a bowling ball fixture with screws to lock the insert in position in the bowling ball fixture for drilling.
Figure 8C:
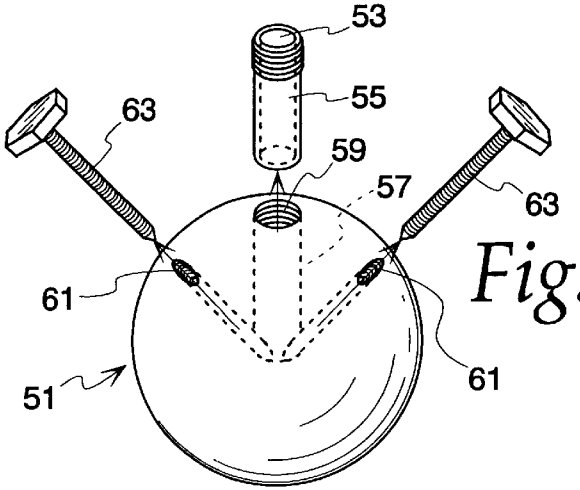
FIG. 8*c* is an exploded view showing the removal of the insert after drilling a thumb hole in the insert.

FIGS. 8*a*, 8*b* and 8*c* of the drawings show a fixture 51 for drilling the internal thumb fitting diameter 53 of a removable thumb insert 55 to fit a particular bowler. The fixture 51 may be an actual bowling ball adapted for use as a drilling fixture or may be another sphere made of the material of a bowling ball or may even be formed of metal. A thumb hole 57 is drilled into the fixture 51 and the upper portion of thumb hole is tapped to provide internal threads 59. A pair of oppositely located small diameter threaded passages 61 are drilled in the fixture 51 to intersect and extend into the thumb hole 57 near its bottom. These threaded passages are each located 45° relative to the axis of the thumb hole 57 and 90° relative to each other and in the same plane. The threaded passages each receive a threaded locking pin 63 which engages the inner end of a solid cylindrical insert 65. The insert has external threads 67 at its outer end which mesh with the internal threads 59 formed in the thumb hole 57. To drill the internal diameter 53 for a thumb in the cylindrical insert 65, the cylindrical insert is screwed into the thumb hole 57 of the fixture 51 and the fixture 51 is placed on a drill press 71 shown in FIG. 8*b* of the drawings. The cylindrical insert 65 is locked into position to prevent its rotation by the threaded locking pins 63 which are threaded into the passages 61 in the fixture to engage the bottom of the insert. A drill bit 73 drills the insert providing the internal passage 53 of a preselected diameter. The pins 63 are unscrewed to release the removable thumb insert 55 from the fixture as shown in FIG. 8*c* of the drawings.

Figure 9:
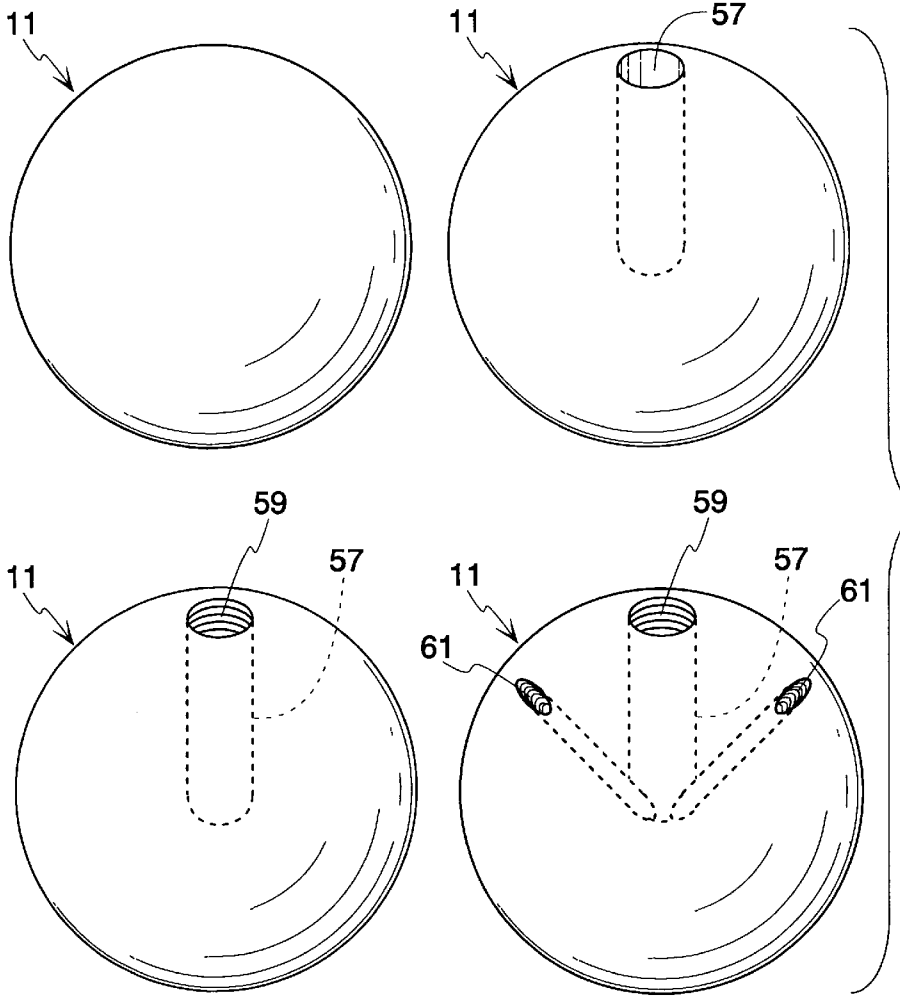
FIG. 9 shows a bowling ball adapted to be used as a fixture similar to the fixture shown in FIGS. 8*a* to 8*c.

FIG. 9 of the drawings shows the steps of converting a bowling ball 11 into a fixture for drilling removable thumb inserts. A thumb hole 57 is drilled into the ball 11 to the proper depth in diameter. Internal threads 57 are then tapped into the top of the thumb hole and then a pair of threaded narrow passages 61 are drilled into the ball 11 to intercept the thumb hole 57.

Figure 10:
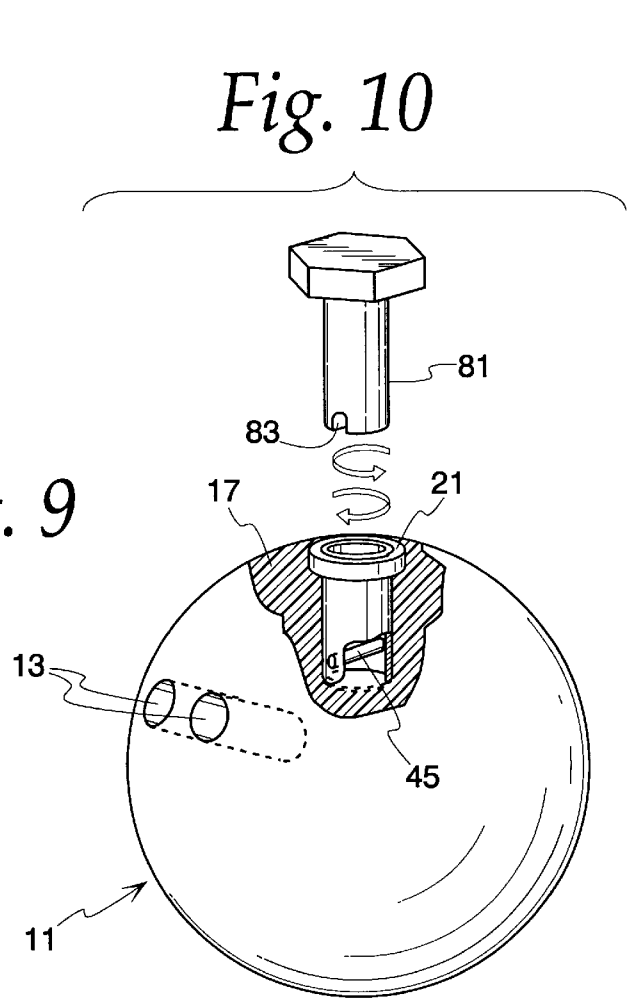
* and FIG. 10 is an exploded view showing a tool for removing a thumb insert from a bowling ball.

FIG. 10 of the drawings shows a tool 81 equipped with a notch 83 at one end for engaging the pin 45 to either remove or insert the thumb insert 37 from a thumb hole in a bowling ball 11.

What is claimed is:

1. A method for adapting a relatively small number of bowling balls for use in testing by a large number of bowlers having different hand sizes, said method including the steps of:

predrilling a pair of finger holes of a standard size in each of said relatively small number of bowling balls, which finger holes are shaped to receive removable finger inserts of varying sizes, predrilling a thumb hole in each of said relatively small number of bowling balls with said thumb hole in each of said bowling balls being located at a different, predetermined distance from said pair of said finger holes so that each of said plurality of bowling balls has a thumb hole at a different distance from said pair of said finger holes, installing a removable insert in each of said thumb holes, and sizing one of said removable inserts in each of said thumb holes of said relatively small number of bowling balls to accommodate the thumb of a bowler testing said bowling ball.

2. The method of claim 1 in which said step of installing a removable thumb insert in each of said thumb holes is preceded by the steps of:

counterboring a larger diameter, shallower hole concentric with said thumb hole, inserting an internally threaded sleeve in said counterbored hole, securing said sleeve in said counterbored hole, and machining said sleeve to conform its outer surface to the outer surface of said bowling ball.

3. The method of claim 1 in which said step of installing a removable thumb insert in each of said thumb holes of said relatively small number of bowling balls is preceded by the steps of:

providing a thumb insert having external threads, tapping said thumb hole in each of said bowling balls to provide internal threads which will mesh with said external threads of said thumb insert when said thumb insert is installed in said thumb hole.

4. The method of claim 3 including the additional steps of:

forming said removable thumb insert as a tube, forming external threads on said tube at one end thereof, forming diametrically aligned passages in said tube at said other end of said tube, and inserting a pin in said aligned passages to extend across a diameter of said tube.

5. The method of claim 3 including the additional steps of:

forming said removable thumb insert as a cylinder, forming external threads on said cylinder at one end thereof, forming a diametrically extending passage through said cylinder at the opposite end of said cylinder, installing said cylinder in said thumb hole with its said external threads meshing with said internal threads of said thumb hole, to secure said cylinder against rotation in said thumb hole, forming a thumb receiving hole in said cylinder to at least the depth of said diametrically extending passage and installing a pin in said diametrically extending passage.

* * * * *